US010240319B2

(12) United States Patent
McLean

(10) Patent No.: US 10,240,319 B2
(45) Date of Patent: Mar. 26, 2019

(54) GROUND SCRAPER

(71) Applicant: Loriden PTY, LTD., Cloncurry (AU)

(72) Inventor: Gregory Charles McLean, Cloncurry (AU)

(73) Assignee: Loriden PTY Ltd., Cloncurry (AU)

( * ) Notice: Subject to any disclaimer, the term of this patent is extended or adjusted under 35 U.S.C. 154(b) by 109 days.

(21) Appl. No.: 15/106,103

(22) PCT Filed: Aug. 11, 2014

(86) PCT No.: PCT/AU2014/050177

§ 371 (c)(1),
(2) Date: Jun. 17, 2016

(87) PCT Pub. No.: WO2015/089573

PCT Pub. Date: Jun. 25, 2015

(65) Prior Publication Data

US 2016/0305086 A1 Oct. 20, 2016

(30) Foreign Application Priority Data

Dec. 18, 2013 (AU) ..... 2013904945

(51) Int. Cl.

| | |
|---|---|
| ***E02F 3/65*** | (2006.01) |
| ***E02F 3/64*** | (2006.01) |
| ***E02F 3/96*** | (2006.01) |

(52) U.S. Cl.

CPC ..... *E02F 3/656* (2013.01); *E02F 3/64* (2013.01); *E02F 3/6409* (2013.01); *E02F 3/6436* (2013.01); *E02F 3/6481* (2013.01); *E02F 3/652* (2013.01); *E02F 3/657* (2013.01); *E02F 3/658* (2013.01); *E02F 3/962* (2013.01)

(58) Field of Classification Search

CPC ..... E02F 3/6454–3/649; E02F 3/654–3/659

See application file for complete search history.

(56) References Cited

U.S. PATENT DOCUMENTS 2,291,858 A * 8/1942 Allin ..... E02F 3/6463 172/456
2,349,576 A * 5/1944 Daniels ..... E02F 3/6472 37/417
2,363,402 A * 11/1944 Daniels ..... E02F 3/6472 37/412

(Continued)

FOREIGN PATENT DOCUMENTS

WO WO2006/066318 A1 6/2006

OTHER PUBLICATIONS

International Search Report and Written Opinion for Application PCT/AU2014/050177, dated Sep. 16, 2014, 6 pages.

*Primary Examiner* — Matthew D. Troutman
(74) *Attorney, Agent, or Firm* — Kinney & Lange, P.A.

(57) ABSTRACT

A ground scraper (10) including: a bowl (12) for holding excavated ground material; a cutting edge (14) mounted at a mouth of the bowl (12) for excavating the ground material; an apron (26) pivotally mounted to the bowl (12) for closing the mouth of the bowl (12); and a hitch assembly (28) including a draft tube (32) and a pair of draft arms (34) extending from the draft tube (32) and pivotally coupled to the bowl (12). Each draft arm (34) including a first portion (36) angled with respect to a second portion (38).

20 Claims, 8 Drawing Sheets

(56) References Cited

U.S. PATENT DOCUMENTS

| | | | | | |
|---|---|---|---|---|---|
| 2,418,554 | A * | 4/1947 | Kadz | E02F 3/6472 | 37/426 |
| 2,606,376 | A * | 8/1952 | Mork | E02F 3/6463 | 298/22 P |
| 2,833,556 | A * | 5/1958 | Kling | B62D 53/068 | 280/405.1 |
| 2,931,111 | A * | 4/1960 | Clark | E02F 3/6481 | 37/421 |
| 3,011,274 | A | 12/1961 | Ritcher | | |
| 3,484,843 | A * | 12/1969 | Martin | E02F 3/64 | 180/420 |
| 3,700,383 | A * | 10/1972 | Boersma | B60P 1/36 | 198/312 |
| 3,977,100 | A * | 8/1976 | Boersma | E02F 3/6481 | 37/416 |
| 4,304,419 | A | 12/1981 | Richardson | | |
| 4,398,363 | A * | 8/1983 | Miskin | E02F 3/64 | 37/429 |
| 2013/0158817 | A1* | 6/2013 | Kingdon | E02F 3/6481 | 701/50 |

* cited by examiner

GROUND SCRAPER

TECHNICAL FIELD

The present invention relates to a ground scraper. In particular, the present invention relates to an improved ground scraper of the type that is towed behind a powered vehicle such as a tractor.

BACKGROUND ART

In land levelling and earthmoving applications, a ground scraper is often employed. Typically, the ground scraper is towed behind a powered vehicle such as a tractor to excavate ground material and level a ground surface. The excavated ground material is then transported to another location. Generally, ground scrapers comprise a cutting edge, referred to as a blade or bit, of adjustable height that is lowered to engage and excavate the ground material and a bowl rearward of the blade in which the excavated ground material is collected as the ground scraper is pulled along.

Once a required volume of ground material has been excavated to level the ground surface or the bowl is full, the cutting edge is raised clear of the ground surface to cease excavation and a gate or "apron" closes an opening at the front of the bowl to retain the excavated ground material in the bowl. Typically, the excavated ground material is that transported to a dumpsite where the apron is opened and a hydraulic ejection ram drives a door at a rear of the bowl forward to expel the excavated ground material from the bowl. Alternatively, in some scrapers, the bowl pivots to tip the excavated material from the bowl.

One type of ground scraper includes a rigid hitching arm forward of the bowl for coupling the scraper to the powered vehicle and a set of wheels, often referred to as walking wheels, rearward of the bowl to support the scraper and enable the scraper to roll along the ground. Whilst this type of scraper is very good at light ground levelling and may be drawn quickly over the ground, the relatively small size of the bowl and the opening into the bowl make it unsuitable for large earthmoving applications. Typically, in such ground scrapers the apron only opens a small distance, which prevents all of the excavated ground material being expelled from the bowl in a single pass of the door or pivot of the bowl. Consequently, the door needs to be driven back and forth a number of times or the bowl needs to be pivoted numerous times to expel or dislodge all of the excavated ground material from the bowl. This is particularly so when the excavated ground material has a high moisture content.

Another problem with prior art aprons is that once the bowl is relatively full, the apron is incapable of forcing any more excavated ground material into the bowl. Similarly, excavated ground material that has been scraped up often accumulates in front of the cutting edge as the scraper moves along and the excavated ground material does not collect in the bowl. Some prior art aprons are incapable of capturing this excavated ground material in the bowl and it has to be left behind. This results in mounds of ground material on an otherwise levelled ground surface that have to be collected once the bowl has been emptied, which is inefficient. Typically, between 20% to 40% of the scraped ground material can be left behind with this type of scraper when the ground material is loose or dry.

A further problem associated with this type of scraper is that the workings of the bowl are prone to clogging when used in wet conditions. Specifically, this particular type of ground scraper has many voids and regions in which ground material can accumulate and be compacted. Consequently, earthmoving and levelling operations may need to be suspended until the scraper is unclogged.

Another problem with some types of scrapers is the relatively large separation between the sets of walking wheels, which makes it difficult to turn the scraper. This, in turn, causes the scraper to rip up the levelled ground surface, often creating ruts of 0.3 m or more and necessitating re-levelling of the ground surface.

The wheels of other types of scrapers are fixed in position and when some of the wheels are not supporting the scraper on the ground, such as when the scraper is used on undulating terrain, high stress can be imparted on one or more of the wheels and/or the frame of the scraper.

Furthermore, most scrapers are susceptible to "duck-walking" on undulating terrain, which impairs the levelling capacity of the ground scraper and the operator must slow down to overcome the duck-walking, thus slowing down the levelling process.

A yet further drawback of the numerous prior art ground scrapers is their complexity of design. Many have a large number of different parts which complicates maintenance and repairs and increases the cost of the scraper.

A range of ground scrapers are disclosed in: U.S. Pat. No. 2,224,438 (Le Bleu), U.S. Pat. No. 3,574,960 (Peterson et al), U.S. Pat. No. 4,393,608 (Hodge), U.S. Pat. No. 6,092,316 (Brinker), U.S. Pat. No. 6,041,528 (Broach), U.S. Pat. No. 5,839,212 (Brinker) and U.S. Pat. No. 6,910,289 (Moyna et al.); United States Patent Application No. 2002/0078606 (Grummett); and former Soviet Union abstracts SU 768884 (Sibe Auto Road Inst.), SU 996648 (Sibirsk Automobil Dorozh), SU 1216292 (Moscow Auto Road Constr.), SU 12571.41 (Mogil Mech. Eng. Inst.) and SU 1602934 (Shavolov et al.). Whilst these scrapers perform theft task satisfactorily, each suffers from one or more of the aforementioned problems.

The applicant has ameliorated one or more of the aforementioned problems by virtue of their ground scraper as disclosed in WO 2006/006318, which is herein incorporated by reference in its entirety. However, the applicant has recognized that further refinements of their invention are required to improve the performance of their ground scraper.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a ground scraper, which may minimize or overcome at least one of the problems mentioned above, or which may provide the public with a useful or commercial choice.

According to a first aspect of the present invention, there is provided a ground scraper including:

- a bowl for holding excavated ground material;
- a cutting edge mounted at a mouth of the bowl for excavating the ground material,
- an apron pivotally mounted to the bowl for closing the mouth of the bowl; and
- a hitch assembly for coupling the ground scraper to a powered vehicle, the hitch assembly including a dry tube and a pair of draft arms extending from the draft tube and pivotally coupled to the bowl,
- wherein each draft arm includes a first portion angled with respect to a second portion.

According to a second aspect of the present invention, there is provided a bowl for holding excavated ground material, said bowl configured for use with a ground scraper including: a cutting edge configured to be mounted at a mouth of the bowl for excavating the ground material; an apron configured to be pivotally mounted to the bowl for closing the mouth of the bowl; and a hitch assembly for coupling the ground scraper to a powered vehicle, the hitch assembly including a draft tube and a pair of draft arms extending from the draft tube and configured to be coupled to the bowl, each said draft arm including a first portion angled with respect to a second portion.

According to a third aspect of the present invention, there is provided a cutting edge for excavating ground material, said cutting edge configured for use with a ground scraper including: a bowl for holding the excavated ground material, an apron pivotally mounted to the bowl for closing a mouth of the bowl; and a hitch assembly for coupling the ground scraper to a powered vehicle, the hitch assembly including a draft tube and a pair of draft arms extending from the draft tube and configured to be coupled to the bowl, each said draft arm including a first portion angled with respect to a second portion, wherein the cutting edge is configured to be mounted at the mouth of the bowl.

According to a fourth aspect of the present invention, there is provided an apron for use with or when used with a ground scraper including:

a bowl for holding excavated ground materials, a cutting edge mounted at a mouth of the bowl for excavating the ground material; and a hitch assembly for coupling the ground scraper to a powered vehicle, the hitch assembly including a draft tube and a pair of draft arms extending from the draft tube and configured to be coupled to the bowl, each said draft arm including a first portion angled with respect to a second portion, wherein the apron is configured to be pivotally mounted to the bowl for closing the mouth of the bowl.

According to a fifth aspect of the present invention, there is provided a hitch assembly for use with or when used with a ground scraper having: a bowl for holding excavated ground material; a cutting edge mounted at a mouth of the bowl for excavating the ground material; and an apron pivotally mounted to the bowl for closing the mouth of the bowl, wherein said hitch assembly is configured to couple the ground scraper to a powered vehicle, said hitch assembly including a draft tube and a pair of draft arms extending from the draft tube and configured to be coupled to the bowl, each said draft arm including a first portion angled with respect to a second portion Advantageously, the angled draft arms of the ground scraper of the present invention allow unimpeded movement of the apron between open and closed positions while still providing a bowl with a larger capacity and better manoeuvrability than prior art ground scrapers.

The angle between the first portion and the second portion of each draft arm may be between about 10° and about 50°, preferably between about 20° and about 40' and more preferably between about 25° and about 35°. In some embodiments, the angle between the first portion and the second portion of each draft arm may be about 33°.

As is usual in the art, the bowl includes a base or floor, opposed longitudinally extending sidewalls and an ejector located at or towards a rear of the bowl for ejecting excavated ground material received through the mouth defined by the base or floor, the opposed sidewalk and the cutting edge. The ejector may span the width of the bowl and be coupled to a hydraulic ram in the form of an ejector ram for moving the ejector between the rear and front of the bowl for ejecting the excavated ground material out of the mouth.

The bowl may further include a front bar extending between the opposed sidewalk at or near an upper portion of the mouth. The front bar may be configured to engage or couple with one end of one or more hydraulic rams in the form of hitch assembly rams, preferably a pair of hitch assembly rams. The other end of the one or more hitch assembly rams may engage or couple with the draft tube to, in use, adjust the height of the bowl relative to the hitch assembly and relative to a ground surface.

As indicated above, the cutting edge, which spans the width of the bowl, is mounted to a mouth of the bowl, preferably to a lower edge portion of the mouth of the bowl, which is angled towards the ground surface typically at an angle of between about 36° to about 43° relative to the ground surface, such that, in use the cutting edge may engage with the ground surface at an angle of between about 36° to about 43° relative to the ground surface. The cutting edge may be mounted by any suitable means to the lower edge portion of the mouth. For example, the cutting edge may be welded and/or mechanically fastened to the lower edge portion.

Likewise, the cutting edge may be mounted to the lower edge portion at any suitable angle relative to the ground surface to facilitate in optimal excavation of differing ground materials. For example, a steeper or greater angle may be used when excavating moist or clay-like ground material whereas a flatter or lesser angle may be used when excavating dry or loose ground material.

The cutting edge may be mounted to the lower edge portion at an angle of about 21° to 58°, about 22° to about 57°, about 23° to about 56°, about 24° to about 55°, about 25° to about 54°, about 26° to about 53°, about 27° to about 52°, about 28° to about 51°, about 29° to about 50°, about 30° to about 49° or about 31° to about 48° relative to the ground surface.

Put another way, the angle of the cutting edge relative to the ground surface may be adjustable by about 1°, about 2°, about 3°, about 4°, about 5°, about 6°, about 7°, about 8°, about 9°, about 10°, about 11°, about 12°, about 13°, about 14° or about 15°. Preferably, the angle of the cutting edge relative to the ground surface may be adjustable by about 5° to about 10°.

The angle of the cutting edge relative to the lower edge portion may be adjusted by any suitable means.

For example, in one embodiment, cutting edges of differing angles may be interchangeably mounted to the lower edge portion with one or more mechanical fasteners and/or weld points. Cutting edges of differing angles may be obtained by machining or bevelling a cutting edge on one side until a desired angle is obtained.

In another embodiment, intermediate members of differing angles may be interchangeably mounted between the lower edge portion and the cutting edge with one or more mechanical fasteners and/or weld points. The intermediate member may be of any suitable size, shape and form to allow the cutting edge to be mounted at a desired angle relative to the ground surface. Preferably, the intermediate member may be in the form of a wedge.

The ground scraper may further include a frame attached to, and rearward of, the bowl and at least one pair of parallel or offset wheels pivotally mounted to the frame.

The frame may include an upper frame member spaced apart from a lower frame member and a pair of spaced apart substantially vertical frame members extending between the upper frame member and the lower frame member.

The at least one pair of parallel or offset wheels may be pivotally mounted between the substantially vertical frame members via an axle pivot assembly.

At least one shock absorber, and preferably a pair of shock absorbers, may be mounted between the axle pivot assembly and the frame.

The at least one shock absorber may have a large bore and short stroke and may permit oscillation of the axle pivot assembly about an axle pin through about 5° and about 25° and preferably between about 10° and about 20°. In some embodiments, the at least one shock absorber may permit oscillation of the axle pivot assembly about the axle pin through about 13°.

In some embodiments, the at least one pair of parallel or offset wheels may be driven by one or more motors mounted on the frame rearward of the bowl, typically between the wheels, or to the axle pivot assembly, preferably the axle pivot assembly. The one or more motors may be of any suitable type. Preferably, however, the at least one pair of parallel or offset wheels may each be driven by a hydraulic or electric motor. Advantageously, driven wheels may generally facilitate in loading the bowl and in providing additional traction on ground surfaces with a steep gradient, such as, e.g., on haul roads.

As indicated above, the ground scraper includes an apron pivotally mounted to the bowl for closing the mouth of the bowl to, in use, retain excavated ground material in the bowl during transportation. In this regard, the apron may be of any size, shape and construction and formed from any material or materials suitably adapted to close the mouth of the bowl to retain excavated ground material contained therein. Likewise, the apron may be pivotally mounted to the bowl by any suitable means.

Typically, the apron may be of a unitary construction formed from a durable material such as metal, preferably steel, and may be sized and shaped to span the mouth of the bowl. Preferably, the apron may be arcuately curved.

The apron may be pivotally mounted by way of a pair of apron arms extending from opposed sides of the apron, each apron arm being pivotally mounted to an adjacent sidewall of the bowl. Each apron arm may be pivotally mounted to one of the sidewalls by an oscillating bearing, preferably a lubricatable oscillating bearing. The oscillating bearing coincides with an axis of rotation of the apron.

The oscillating bearing may include a housing that may be attached to the apron arm and a mounting shaft that may be attached to the sidewall. The oscillating bearing may include an oscillating seal between the housing and the mounting shaft, preferably providing a gap of about 1 mm between the housing and the mounting shaft. In use, the oscillating bearings may be flushed with grease periodically (e.g., daily) to prevent the ingress of ground material.

Advantageously, the inventor has found that oscillating bearings allow for any welding misalignments and prevent damage due to twisting of the apron caused by, for example, rocks or other hard objects being trapped between the apron and an edge of the mouth of the bowl. Additionally, the use oscillating bearings creates less noise pollution than other types of bearings such as, e.g., dry trunnion bearings.

The ground scraper may further include a plate detachably mountable to each apron arm. The plate is sized and shaped to prevent excavated ground material escaping from the bowl through an aperture in each sidewall through which the apron arms respectively pass.

To close the mouth of the bowl, the apron is closed or lowered by a pair of hydraulic rams in the form of apron rams. Similarly, the apron may be raised or opened by the apron rams to open the mouth of the bowl when levelling a ground surface and collecting excavated ground material in the bowl, and when ejecting collected excavated ground material from the bowl.

One apron ram may be located on either side of the apron. Each apron ram may be pivotally coupled at one end to an adjacent apron arm and may be pivotally coupled at the other end to an adjacent sidewall of the bowl. The apron rams may be pivotally coupled by any suitable means.

When the apron is in a closed position, a coupling point between the apron and each apron rain may lie beyond a vertical plane extending through a point at which the apron is pivotally mounted to the bowl. Preferably, the coupling point between the apron and the apron rains may lie about 10° beyond the vertical plane.

When the apron is in an open position, the coupling point between the apron and the apron rains may lie about 3° above the horizontal plane extending through a point at which the apron is pivotally mounted to the bowl.

As indicated above, the apron may be arcuately shaped having arc-shaped profile that facilitates the apron, in use, in closing through the excavated ground material rather than attempting to push the excavated ground material into the bowl. Advantageously, this enables the apron to close when the bowl is full and/or without first raising the bowl relative to the hitch assembly and the ground surface.

The ground scraper may further include a push pad defined at a rear end of the ground scraper by the frame, preferably the upper frame member and the lower frame member. The push pad may be located to the rear of the at least one pair of parallel or offset wheels and may be configured to receive a force, for example by a bulldozer, to aid in the loading of the ground scraper and/or to aid in extracting the ground scraper in the event that it becomes bogged, for example, in soft terrain.

The other end of the ejector ram for moving the ejector between the rear and front of the bowl for ejecting the excavated ground material out of the mouth may be coupled to a rear portion of the frame adjacent the push pad.

The frame may further include a horizontal support frame member extending substantially along a central longitudinal axis of the ground scraper between the push pad and the base or floor of the bowl to at least partially support the push pad. Preferably, the horizontal support frame member may extend between the push pad and the base or floor of the bowl beneath the ejector ram to advantageously protect the ejector ram from damaging stray rocks flicked up when the ground scraper is unloading.

The ground scraper may further include a coupling mechanism that may or may not be used in conjunction with the push pad in coupling at least two ground scrapers in a tandem or serial arrangement, also known as a "push-pull" arrangement.

The coupling mechanism may be of any suitable form to allow a rearward ground scraper to be pulled by a forward ground scraper. For example, the coupling mechanism may be in the form of a tow or hitch ball or bar. Typically, however, the coupling mechanism may be in the form of a mounting frame with an associated pulling hook mounted adjacent the push pad atop the frame of the ground scraper, preferably forward of the push pad so as not to impair access to the push pad. The pulling hook may be configured to be coupled or hooked either directly or indirectly to a front end of a rearward ground scraper.

In a preferred embodiment, the mounting frame associated pulling hook may be mounted atop the upper frame of the ground scraper via one or more mounting plates welded to the upper frame. The mounting frame and associated pulling hook may be mechanically fastened to the one or more mounting plates.

In use, a rearward ground scraper may push against the push pad of a forward around scraper. Likewise, a forward ground scraper may pull a rearward ground scraper by way of the coupling mechanism. Overall, use of a push-pull arrangement may be advantageous when levelling a ground surface and excavating difficult to load ground material or during adverse conditions, such as, for example on an inclined slope or on ground material that provides poor traction.

Any of the features described herein can be combined in any combination with any one or more of the other features described herein within the scope of the invention.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

Figure 1:
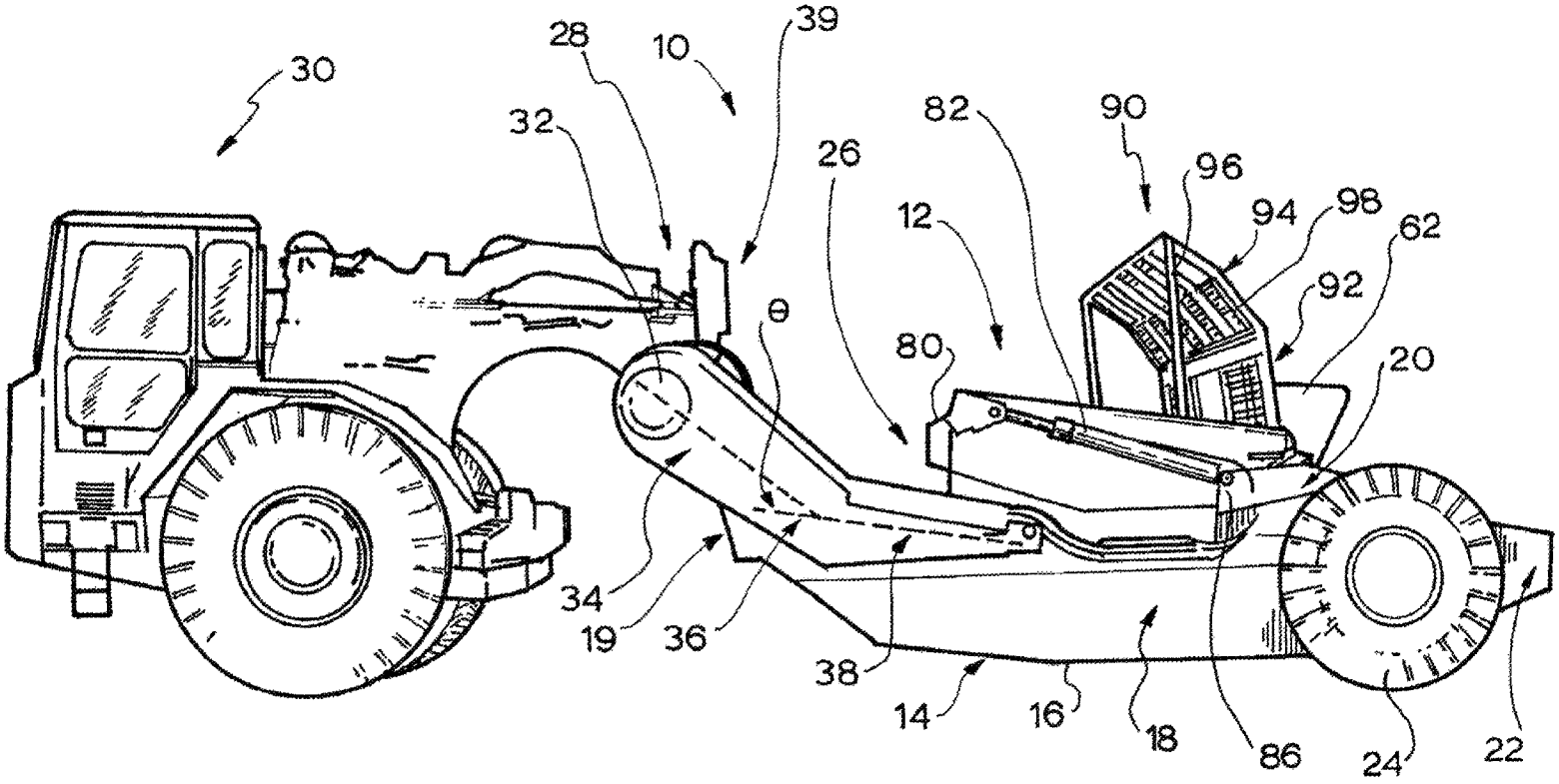
FIG. 1 is a side elevation of an improved ground scraper according to an embodiment of the present invention showing the ground scraper coupled to a powered vehicle and an apron of the ground scraper in a semi-open position.

Skilled addressees will appreciate that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION

FIG. 1 shows a ground scraper 10 according to an embodiment of the present invention. The ground scraper 10 includes: a bowl 12 for holding excavated ground material; a cutting edge 14 mounted at a mouth of the bowl 12 for excavating the ground material; an apron 26 pivotally mounted to the bowl 12 for closing the mouth of the bowl 12; and a hitch assembly 28 including a draft tube 32 and a pair of draft arms 34 extending from the draft tube 32 and pivotally coupled to the bowl 12. Each draft arm 34 includes a first portion 36 angled with respect to a second portion 38.

The bowl 12 is formed from a base or floor 16, opposed longitudinally extending sidewalls 18 and an ejector door 62 (i.e., ejector) located at a rear of the bowl 12 for ejecting excavated ground material received through the mouth of the bowl 12. The mouth of the bowl 12 is defined by the base or floor 16, the sidewalls 18 and the cutting edge 14. The ejector door 62 spans the width of the bowl 12 and is coupled to a hydraulic ram in the form of an ejector ram (shown in FIG. 2) for moving the ejector door 62 between the rear and front of the bowl 12 for ejecting the excavated ground material out of the mouth. The ejector door 62 and ejector ram will be described in more detail below.

The bowl 12 further includes a front bar 19 that extends between the sidewalls 18 at or near an upper portion of the mouth. A pair of hydraulic rains in the form of hitch assembly rams 39 are each coupled at one end to the front bar 19 and at the other end to the draft tube 32 to, in use, adjust the height of the bowl 12 relative to the hitch assembly 28 and relative to a ground surface.

As indicated above, the cutting edge 14, which spans the width of the bowl 12, is mounted to the mouth of the bowl 12 for excavating ground material. The cutting edge 14 is mounted by being welded and/or bolted (i.e., mechanically fastened) to a mouldboard (i.e., lower edge portion) of the mouth, which angles towards the ground surface at angle of between about 36° to about 43° relative to the ground surface, such that, in use the cutting edge may engage with the ground surface at an angle of between about 36° to about 43° relative to the ground surface.

To facilitate in optimal excavation of differing ground material (i.e., moisture content), the cutting edge 14 can be mounted to the mouldboard at differing gradients or angles relative to the ground surface. To adjust the angle of the cutting edge 14 relative to the ground surface, intermediate plates in the form of wedges can be interchangeably mounted between the cutting edge 14 and the mouldboard.

Typically, the angle of the cutting edge 14 relative to the ground surface can be adjusted by between about 5° to about 10°.

The ground scraper 10 includes, rearward of the bowl 12, a transverse frame member 20 attached to sidewalls 18 such that the transverse frame member 20 spans the width of the bowl 12. A frame 22 is connected to the transverse frame member 20 by any suitable means known in the art, such as, for example, welding. Wheels 24 are rotatably and pivotally mounted to the frame 22 via an axle pivot assembly. The frame 22 and mounting of the wheels 24 thereto will be described in more detail below.

The apron 26 is pivotally mounted to the bowl 12 to close the mouth of the bowl 12 and retain the excavated material in the bowl 12 for transportation. FIG. 1 shows the apron 26 in a semi-open position and the apron 26 will be described in more detail below.

Referring to the hitch assembly 28, each draft arm 34 of the hitch assembly 28 is pivotally coupled to the outside of each sidewall 18 of the bowl 12. The bend or angle in the draft arms 34 between the first portion 36 and the second portion 38 enables unimpeded movement of the apron 26, even when the bowl 12 is fully lowered relative to the hitch assembly 28, draft arms 34 and the ground surface.

In accordance with some embodiments, the angle θ between the first portion 36 and the second portion 38 of the draft arms 34 is between about 10° to about 50°. The angle θ is measured between the centre lines of the first portion 36 and the second portion 38. In preferred embodiments, the angle θ is between about 20° and about 40°. In a more preferred embodiment, the angle θ is between about 25° and about 35°. In some embodiments, the inventor has found that an angle θ of about 33° between the first portion 36 and the second portion 38 is optimum.

Figure 2:
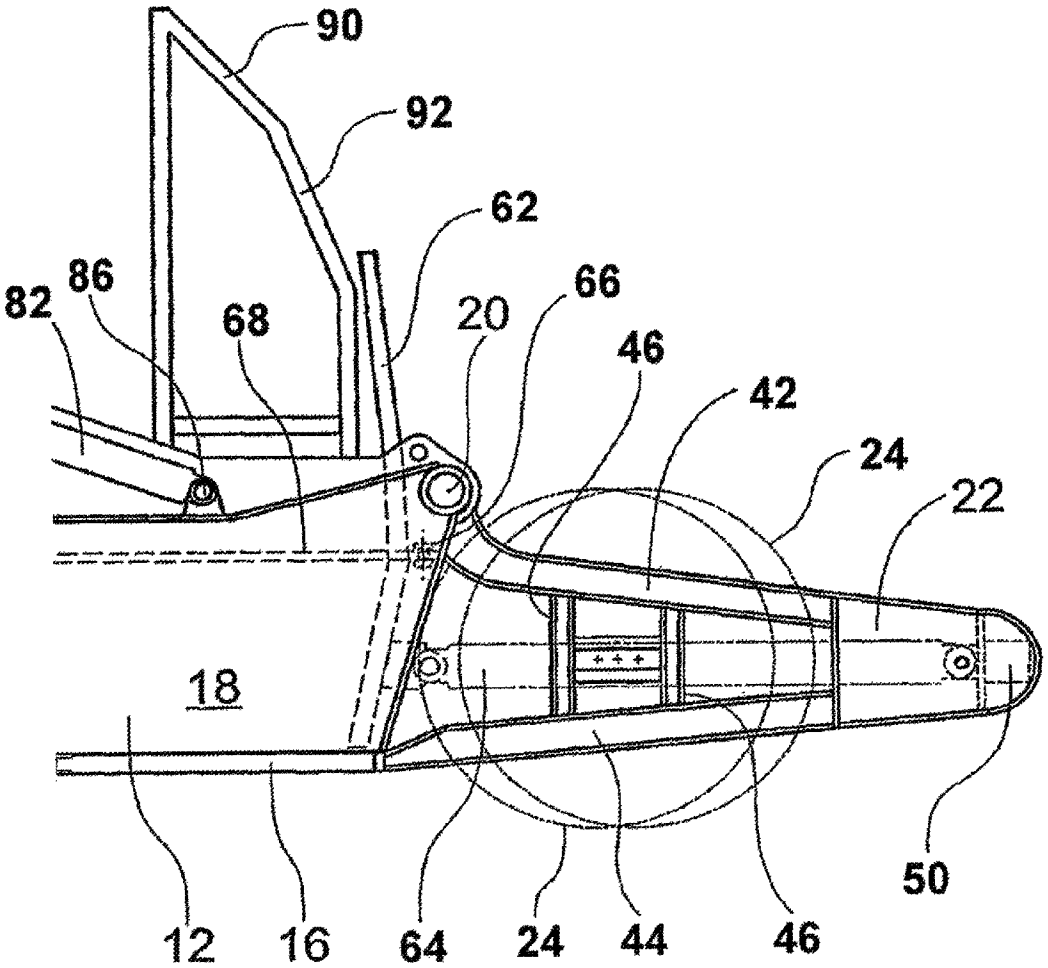
FIG. 2 is a side elevation of a rear portion of the ground scraper according to another embodiment.

With reference to FIG. 2, the frame 22 includes an upper frame member 42 spaced apart from a lower fame member 44 and a pair of spaced apart substantially vertical frame members 46 extending between the upper frame member 42 and the lower frame member 44. At least one pair of parallel or offset wheels 24 is pivotally mounted between the substantially vertical frame members 46 via an axle pivot assembly 48 (shown in FIGS. 3 and 4), and an axle pin (not shown). In a preferred embodiment, two pairs of offset wheels 24 are pivotally mounted between the substantially vertical frame members 46 on both sides of the frame 22.

The frame 22 and transverse frame member 20 are made from hollow sections of 350 grade steel, which provide good resistance to deflections and twisting. However, alternative grades of steel may be employed. The frame 22 and transverse frame member 20 may further comprise extra gussets at corner regions to provide added strength.

In use, excavated ground material and in particular very large clods of excavated ground material can pass over the ejector door 62 by the forward motion of the ground scraper 10 and/or by additional excavated ground material entering the bowl 12. Such large clods can potentially damage the frame 22 and wheels 24 of the ground scraper 10. To address this problem while maintaining the large capacity of the ground scraper 10, a guard 90 is detachably mounted to the sidewalls 18 of the bowl 12 to prevent such overflow. The guard 90 comprises a pair of side frames 92, a plurality of transverse frame members 94 extending between the side frames 92 across the width of the bowl 12 and a plurality of vertical members 96. Mesh 98 is fastened to the transverse frame members 94 and vertical members 96 by any suitable means, such as welding, to stop the overflow of the excavated ground material. The guard 90 includes an opening 100 below the mesh 98 to allow passage of the ejector door 62 therethrough.

A push pad 50 is defined at a rear end of the ground scraper 10 and extends between the upper and lower frame members 42, 44. A horizontal support frame (not shown) extends substantially along a central longitudinal axis of the ground scraper 10 between an inner surface of the push pad 50 and the base or floor 16 of the bowl 12 to support the push pad 50. The push pad 50 is configured to receive a force, for example by a bulldozer, to aid in the loading of the ground scraper 10 and/or to aid in extracting the ground scraper in the event that it becomes bogged, for example, in soft terrain.

Figure 3:
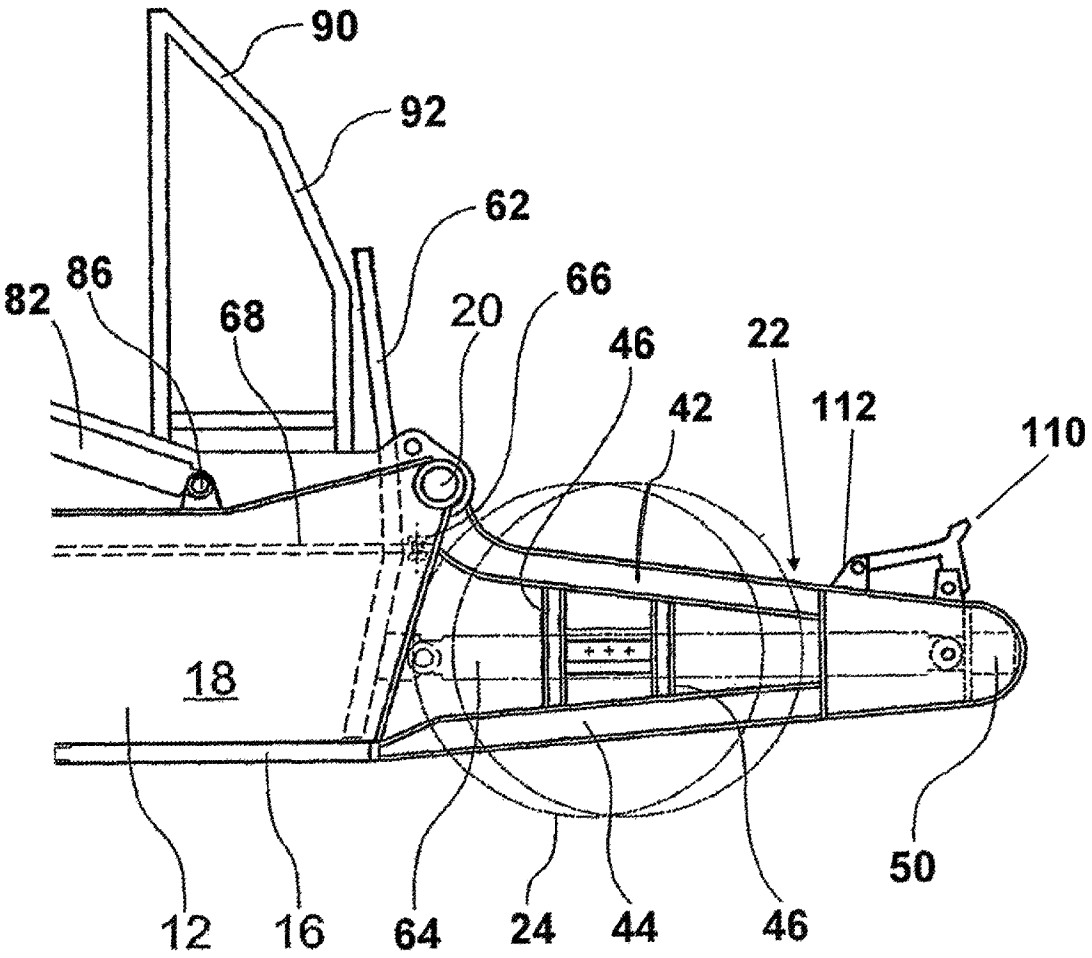
FIG. 3 is another side elevation of a rear portion of the ground scraper according to another embodiment.

With reference to FIG. 3, embodiments of the ground scraper 10 include a pull hook 110 (i.e., coupling mechanism) to facilitate in coupling at least two ground scrapers 10 in a tandem or serial (i.e., front to rear) arrangement, also known as a "push-pull" arrangement.

The pull hook 110 is positioned atop the frame 22 of the ground scraper 10 forward of the push pad 50. The pull hook 110 is configured to be indirectly coupled to a front end of a rearward ground scraper. The pull hook 110 is mounted to two pull hook support frame members (not shown), which extend forward of the push pad 50 toward the bowl 12. The pull hook 110 is mounted to the two pull hook support frame members via two mounting plates 112 welded atop the two pull hook support frame members, and via a third mounting plate 112 welded atop the push pad 50. The pull hook 110 is pinned to the mounting plates 112.

In use, a rearward ground scraper can push against the push pad 50 of the ground scraper 10. Likewise, the ground scraper 10 can pull the rearward ground scraper by way of the pull hook 110. This is advantageous when levelling a ground surface and excavating ground material during adverse conditions, such as, for example on an inclined slope or on ground material that provides poor traction. It also is advantageous when levelling and excavating hard ground material (e.g., compressed ground material or ground material with a high rock content).

Figure 5:
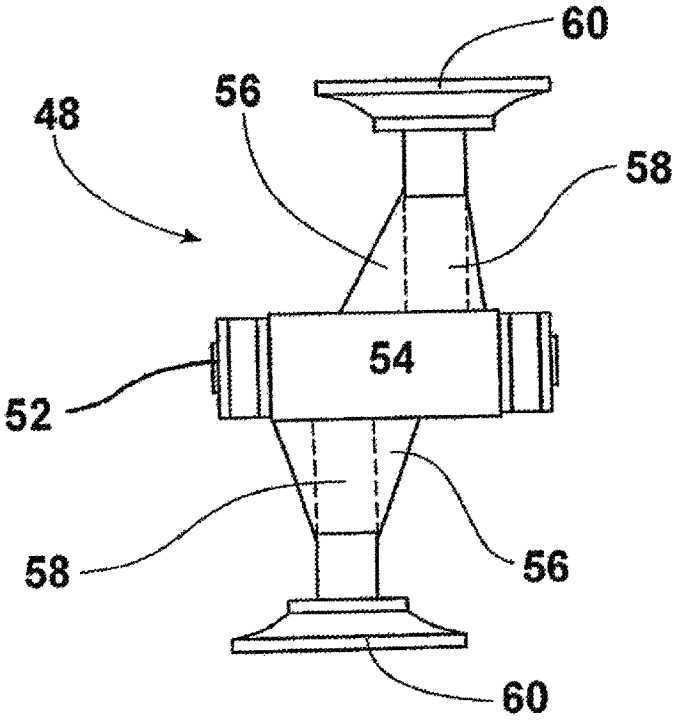
FIG. 5 is a plan view of the axle pivot assembly shown in FIG. 4.
Figure 4:
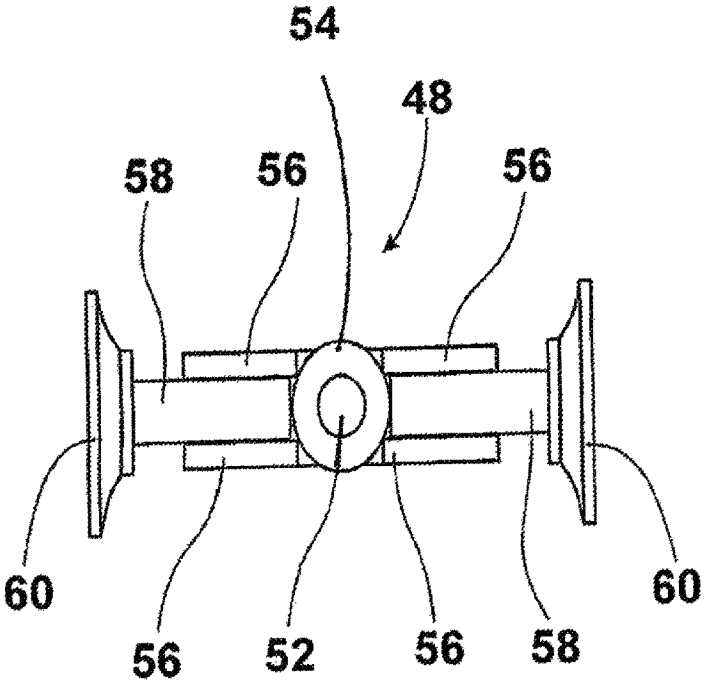
FIG. 4 is a front elevation of an axle pivot assembly of the ground scraper according to another embodiment.

With reference to FIGS. 4 and 5, each axle pivot assembly 48 includes a pivot pin 52 within a housing 54, which includes replaceable bushings (not shown). Gussets 56 are welded to the housing 54, which accommodate a pair of axles 58. Flubs 60 are mounted to the axles 58. For the sake of clarity, tyres have been omitted from FIGS. 4 and 5. The pivot pin 52 of each axle pivot assembly 48 is pivotally mounted to the substantially vertical frame members 46 to allow the axle pivot assemblies 48 to pivot.

In some embodiments, the at least one pair of parallel or offset wheels 24 are driven by individual wheel motors mounted between the substantially vertical frame member 46 on each axle pivot assembly 48. The wheel motors can be hydraulic or electric.

Figure 6:
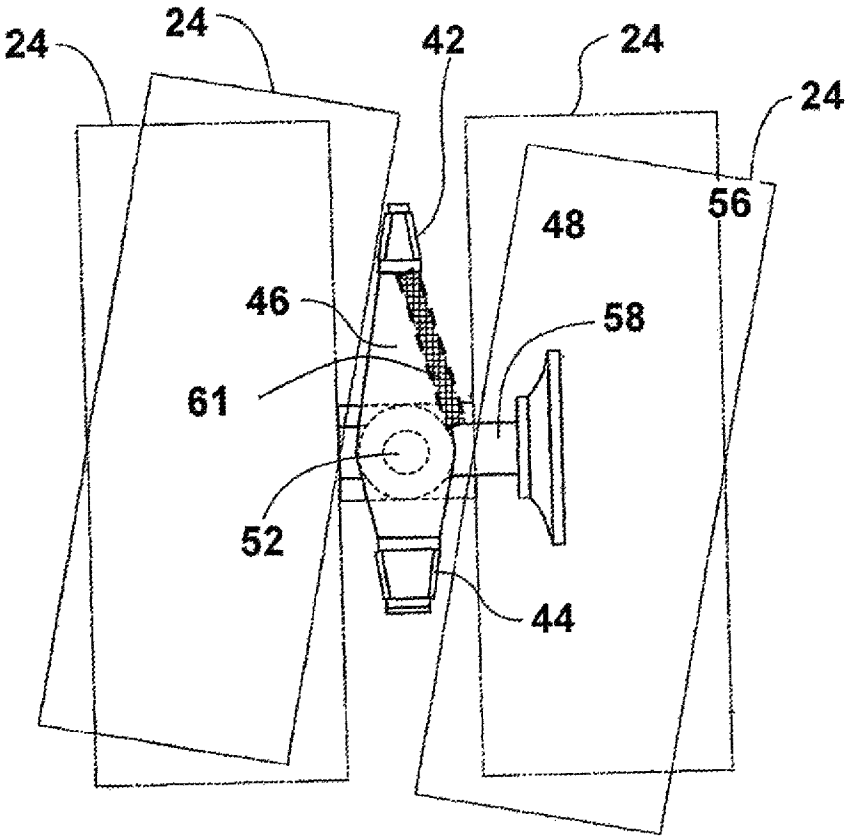
FIG. 6 is a rear elevation of an axle pivot assembly of the ground scraper according to another embodiment.

With reference to FIG. 6, the substantially vertical frame members 46 are welded to the upper frame members 42 and the lower frame members 44. From the mounting points of the axle pivot assemblies 48, the substantially vertical frame members 46 taper toward the upper frame members 42 and taper toward the lower frame members 44. Additionally, the upper frame members 42 taper upwardly and the lower frame members 44 taper downwardly.

The above described arrangement enables the ground scraper 10 to follow the contours of the ground whilst negotiating potholes, ruts and the like. Advantageously, this arrangement avoids undue stress being placed on the wheels 24, axle assemblies 48 and/or frame 22 to which the axle assemblies 48 are mounted. The tapering of the upper and lower frame members 42, 44 and the substantially vertical frame members 46 also improve the extent of pivoting achievable by the wheels 24, whilst maintaining strength in the frame 22. A typical pivoting angle of the wheels 24 from the vertical is about 1.3°.

To reduce the problem of "duck walking", particularly in rough uploading conditions, at least one shock absorber 61 is mounted between the axle pivot assembly 48 and the frame 22. Preferably, a pair of shock absorbers 61 is mounted between each axle pivot assembly 48 and the frame 22. The one or more shock absorbers 61 can be mounted between the axle pivot assembly 48 and the upper frame member 42 and/or the lower frame member 44 by any suitable means known in the art.

FIG. 6 shows schematically a single shock absorber 61 coupled between the underside of the upper frame member 42 and the axle pivot assembly 48. Suitable shock absorbers have a large bore and short stroke and permit oscillation of the axle pivot assembly 48 about the axle pin through between about 5° and about 25°, preferably through between about 10° and about 20° and more preferably through about 13°.

Whilst two axle assemblies 48 are provided in the embodiment described herein, a person skilled in the art will appreciate that a single wheel assembly can be provided in an alternative embodiment comprising a wide tyre. Alternatively, more than two assemblies 48 can be provided in a further alternative embodiment.

Turning back to FIG. 2, the ejector door 62 is coupled to one end of the ejector ram 64. The other end of the ejector ram 64 is coupled to a rear portion of frame 22 adjacent the push pad 50. In use, excavated ground material is ejected from the bowl 12 via the mouth by the ejector ram 64 moving the ejector door 62 from the rear of the bowl 12 toward the mouth. Advantageously, the horizontal support frame member (not shown) extends between the inner surface of the push pad 50 and the base or floor 16 of the bowl 12 beneath the ejector ram 64 to protect the ejector ram 64 from damaging stray rocks flicked up when the ground scraper 10 is unloading.

Smooth motion of the ejector door 62 is aided by rollers 66 rotatably mounted to each side of the ejector door 62, which move on respective roller guides 68 mounted to an inside surface of each sidewall 18 of the bowl 12.

Alternative embodiments may include more than one single roller 66 and roller guide 68 on each side of the ejector door 62. For example, rollers 66 rotatably mounted on elongate members extending rearwardly from the ejector door 62 and configured to move on the roller guides 68 attached to the frame 22 can help to maintain smooth motion of the ejector door 62 in the bowl 12. For example, in one embodiment, roller guides 68 attached to each of the opposed sides of the horizontal support frame can guide rollers 66 rotatably mounted on elongate members extending rearwardly from the ejector door 62.

Figure 7:
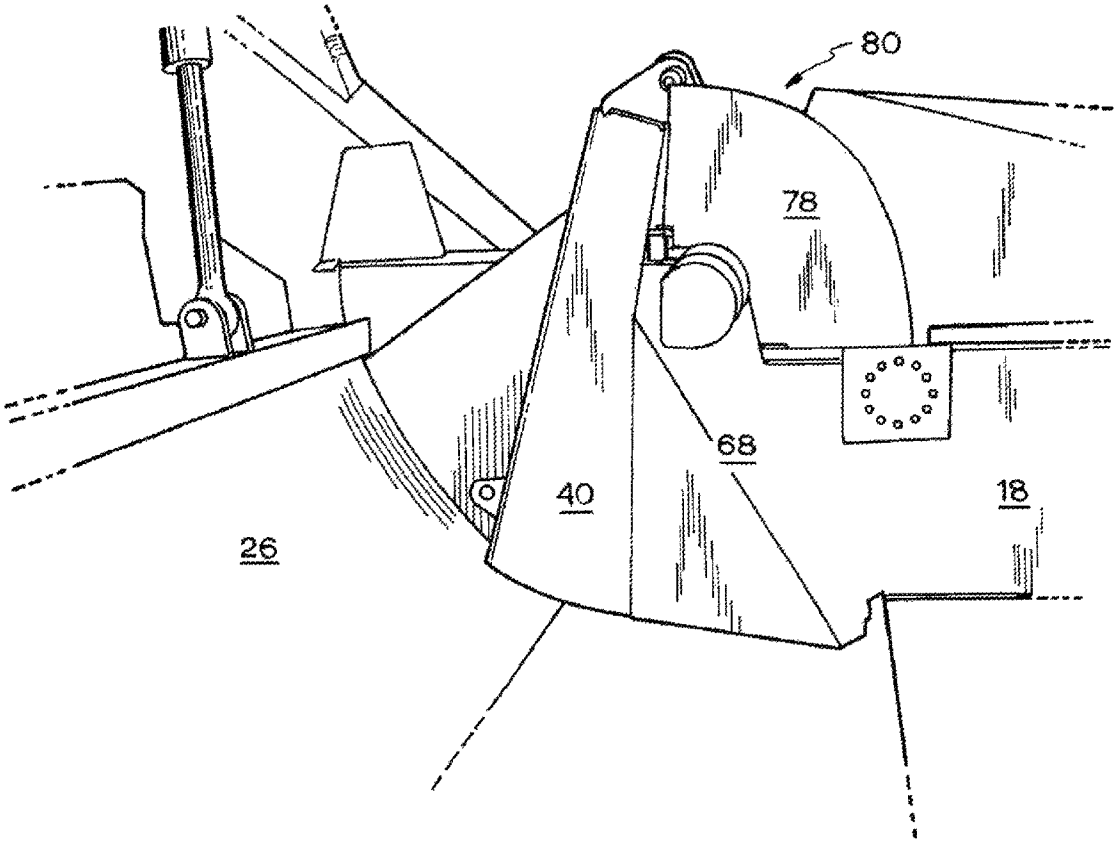
FIG. 7 is a perspective view of an apron and a bowl of the ground scraper shown in FIG. 1.
Figure 9:
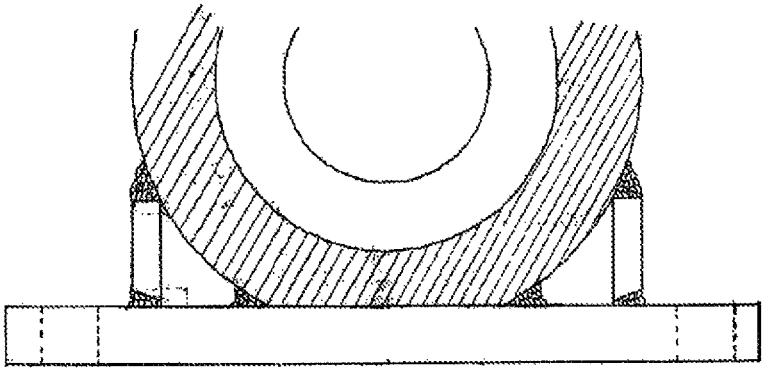
FIG. 9 is a sectional side view of a housing of the bearing shown in FIG. 8.
Figure 8:
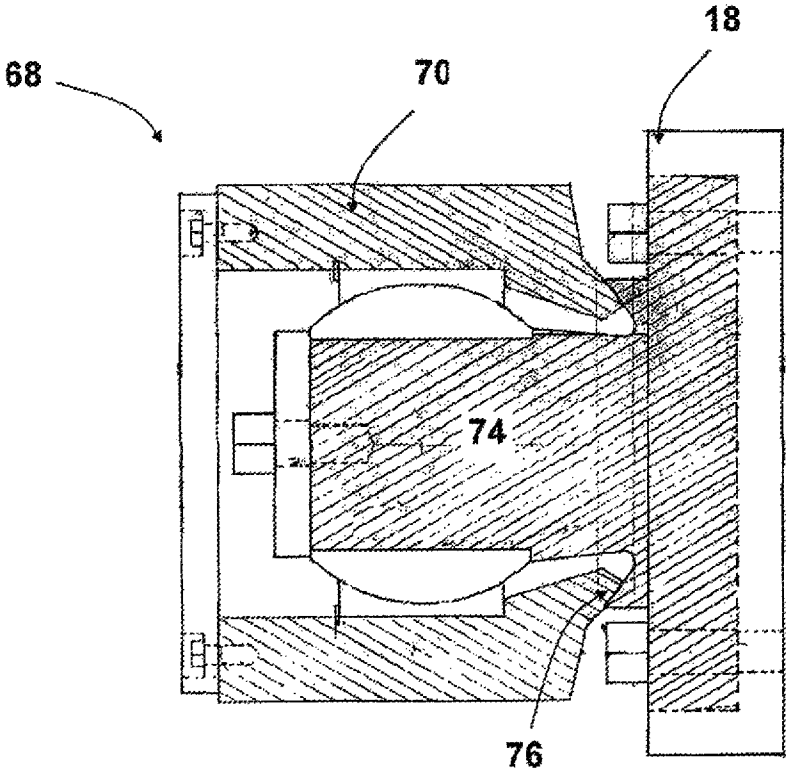
FIG. 8 is a sectional view of an oscillating bearing for the apron shown in FIG. 7.

With reference to FIGS. 7 to 9, the apron 26 is pivotally mounted to the bowl 12 for closing the mouth of the bowl 12 to, in use, retain excavated ground material within the bowl 12 during transportation.

The apron 26 is of unitary construction and is sized and shaped to span the mouth of the bowl 12.

The apron 26 is pivotally mounted by way of a pair of apron arms 40 extending from opposed sides of the apron 26. Each apron arm 40 is pivotally mounted to an adjacent sidewall 18 of the bowl 12 by an oscillating bearing 68. The oscillating bearing 68 coincides with an axis of rotation of the apron 26.

A plate 78 detachably mountable to each apron arm 40 is used to prevent excavated around material escaping from the bowl 12 through an aperture 80 in each sidewall 18 through which the apron arms 40 respectively pass.

Referring to FIGS. 8 and 9, the oscillating bearing 68 is lubricatable and includes a housing 70 attached to the apron arm 40 and a mounting shaft attached to the sidewall 18. The oscillating bearing 68 defines a gap of about 1 mm between the housing 70 and the mounting shaft 74. In use, the oscillating bearings 68 are be flushed with grease periodically (e.g., daily) to prevent the ingress of ground material.

Best shown in FIGS. 1 and 2, the apron 26 is closed or lowered to close the mouth of the bowl 12 by a pair of hydraulic rams in the form of apron rams 82. Likewise, the apron 26 is raised or opened to open the mouth of the bowl 12 when levelling a ground surface and collecting excavated ground material in the bowl 12, and when ejecting collected excavated ground material from the bowl 12.

An apron ram 82 is located on either side of the apron 26. Each apron ram 82 is pivotally coupled at one end to an adjacent apron arm 40 at coupling point 84, and is pivotally coupled at the other end to an adjacent sidewall 18 of the bowl 12 at pivot point 86. The apron rams 82 may be pivotally coupled by any suitable means.

Figure 10:
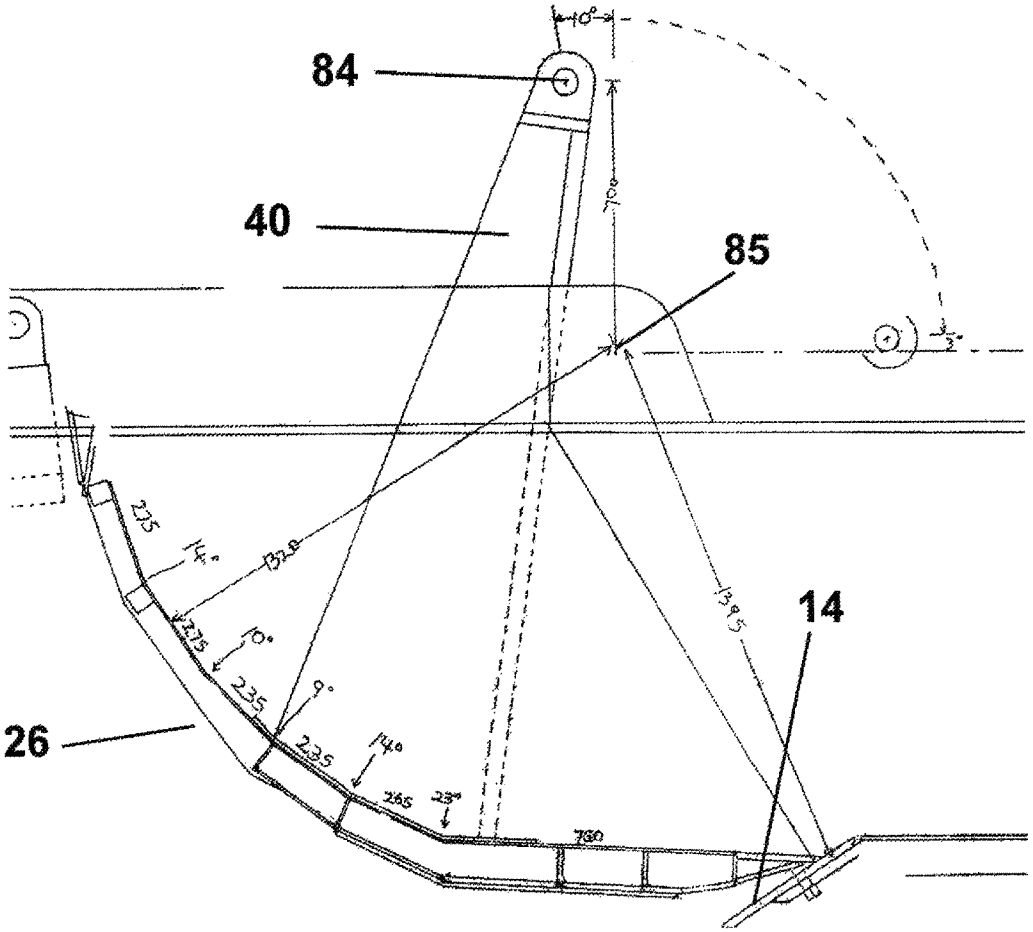
FIG. 10 is side elevation showing a distance of travel of the apron between open and closed positions of the ground scraper according to another embodiment.

Referring to FIG. 10, when the apron 26 is in a closed or lowered position, coupling point 84 lies beyond a vertical plane extending through pivot point 85 (where the apron 26 is pivotally mounted to the bowl and which coincides with the axis of the mounting shaft of the oscillating bearing).

In some embodiments, the coupling point 84 lies about 10° beyond the vertical plane. Advantageously, this additional closing distance provides more power for the apron 26 to close through ground material excavated by the ground scraper 10.

Again referring to FIG. 10, when the apron 26 is in an open or raised position, coupling point 84 lies about 3° above a horizontal plane extending through pivot point 85. This results in less stress on each apron arm 40 and the apron rams 82.

As indicated above, the apron 26 is arcuately shaped having an arc-shaped profile that facilitates the apron 26, in use, in closing through the excavated ground material rather than attempting to push the excavated ground material into the bowl 12. Advantageously, this enables the apron 26 to close when the bowl 12 is full and/or without first raising the bowl 12 relative to the hitch assembly 28 and the ground surface. This is particularly effective when the bowl 12 is full of compressed excavated earth.

The hydraulic rams used in the ground scraper 10 have a large volume and length of travel thereby maximising the power available for opening and closing the apron 26, moving the ejector door 62 and raising and lowering the bowl 12.

In one embodiment, the apron rams 82 have a 40"×6.4" bore (approx. 101.6 cm×16.5 cm bore). The skilled addressee will appreciate that a correspondingly large oil supply from a hydraulic circuit will be required and that the particular hydraulic circuit can be tailored according to the combination or rams employed.

Hence, the improved ground scraper of the present invention provides a solution to at least some of the aforementioned problems associated with the prior art since the ground scraper of the present invention has a larger capacity whilst still being more manoeuvrable than some of the prior art scrapers. The notable ground clearance of the scraper of the present invention in comparison to some of the prior art scrapers, enables the scraper to be used on rough, undulating terrain and helps the scraper to be utilized in wet conditions this if further facilitated by the pivotally mounted walking wheels with large bore, short stroke shock absorbers, which also prevent undue stress being placed on the frame, wheels or axles and prevent ruts being created in the levelled ground especially when turning. The tapered frame members allow a good pivoting range for the walking wheels. The powerful apron with the arced profile which closes about 10° beyond the vertical plane enables the apron to close through the excavated ground material when the bowl is full. The apron also has the power to be closed through the excavated ground material without the need to first raise the bowl, thus providing a more versatile ground scraper. The angled draft arm accommodates the substantial apron arms, which protrude through the sidewalls whilst the detachable plates prevent excavated material escaping from the bowl through the aperture in the sidewall. The oscillating bearings allow for any welding misalignments, prevent damage due to twisting of the apron cause by rocks or other obstacles and also avoid the noise pollution created by dry trunnion bearings.

Throughout the specification the aim has been to describe the invention without limiting the invention to any one embodiment or specific collection of features. Persons skilled in the relevant art may realize variations from the specific embodiments that will nonetheless fall within the scope of the invention.

In the present specification and claims (if any), the word 'comprising' and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A ground scraper comprising;

a bowl comprising a base and opposed sidewalls for holding excavated ground material;

a cutting edge mounted at a mouth of the bowl for excavating the ground material;

an apron pivotally mounted to the bowl for closing the mouth of the bowl;

an ejector movable between a rear of the bowl and a front of the bowl to eject excavated ground material out of the mouth of the bowl;

a frame rearward of the bowl to which wheels are rotatably and pitotally mounted and a hitch assembly for coupling the ground scraper to a powered vehicle, the hitch assembly comprising a draft tube and a pair of draft arms extending from the draft tube, each draft arm and pivotally coupled to respective one of the sidewalls of the bowl part way along the sidewalls and forward of the wheels;

wherein each draft arm comprises an angle of between about 20° and about 40° between a first portion of the draft arm-and a respective second portion of the draft arm, wherein the first portion is fixed relative the second portion.

2. The ground scraper of claim 1, wherein the wheels comprise at least one pair of parallel or offset wheels pivotally mounted to the frame.

3. The ground scraper of claim 2, wherein the frame comprises an upper frame member spaced apart from a lower frame member and a pair of spaced apart substantially vertical frame members extending between the upper frame member and the lower frame member, the at least one pair of parallel or offset wheels being pivotally mounted between the substantially vertical frame members via an axle pivot assembly.

4. The ground scraper of claim 3, wherein at least one shock absorber is mounted between the axle pivot assembly and the frame.

5. The ground scraper of claim 4, wherein the at least one shock absorber has a large bore and short stroke and permits oscillation of the axle pivot assembly about an axle pin through between about 5° and about 25°.

6. The ground scraper of claim 3, wherein each wheel is driven by a motor mounted on the axle pivot assembly.

7. The ground scraper of claim 1, wherein the cutting edge is mounted to a lower edge portion of the mouth and an angle of the cutting edge relative to the ground surface is adjustable by about 5° to about 10° relative to the ground surface to facilitate in the excavating of differing ground materials.

8. The ground scraper of claim 7, wherein the angle of the cutting edge relative to the ground surface is adjustable by mounting an intermediate member in the form of a wedge between the lower edge portion and the cutting edge until the cutting edge is mounted at a desired angle relative to the ground surface.

9. The ground scraper of claim 1, wherein the apron is pivotally mounted to the bowl by way of a pair of apron arms extending from opposed sides of the apron, each apron arm being pivotally mounted to one of the sidewalls via oscillating bearings, which coincide with an axis of rotation for the apron.

10. The ground scraper of claim 9, wherein the apron is opened or closed by a pair of apron rams located on either side of the apron, each apron ram being pivotally coupled at one end to one of said apron arms and at the other end to one of said sidewalls of the bowl.

11. The ground scraper of claim 10, wherein when the apron is in a closed position, a coupling point between the apron and the apron rams lies beyond a vertical plane extending through a pivot point at which the apron is pivotally mounted to the bowl.

12. The ground scraper of claim 11, wherein the coupling point lies about 10° beyond the vertical plane.

13. The ground scraper of claim 11, wherein when the apron is in an open position, the coupling point lies about 3° above the horizontal plane extending through the pivot point.

14. The ground scraper of claim 1, wherein the apron is arcuately shaped having an arc-shaped profile that facilitates the apron in closing through the excavated ground material rather than attempting to push the excavated ground material into the bowl.

15. The ground scraper of claim 9, further comprising a plate detachably mountable to each apron arm, said plate being sized and shaped to prevent excavated ground material escaping from the bowl via an aperture in each said sidewall through which the aprons arms respectively pass.

16. The ground scraper of claim 1, further including a coupling mechanism mounted atop a rear end of the ground scraper to facilitate in the coupling of at least two ground scrapers in tandem or serial arrangement.

17. The ground scraper of claim 16, wherein the coupling mechanism includes a mounting frame and associated pulling hook configured to be mounted atop the frame of the ground scraper adjacent the push pad, said pulling hook being configured to be coupled or hooked either directly or indirectly to a front end of a rearward ground scraper.

18. The ground scraper of claim 17, wherein the mounting frame and associated pulling hook is mounted atop the frame of the ground scraper via one or more mounting plates welded to the frame, the mounting frame and associated pulling hook being mechanically fastened to the one or more mounting plates.

19. The ground scraper of claim 1, further including a horizontal support frame extending substantially along a central longitudinal axis of the ground scraper between an inner surface of a push pad located at rear of the ground scraper and the base or floor of the bowl to provide support to the push pad.

20. The ground scraper of claim 19, wherein the horizontal support frame includes roller guides attached on opposed sides of the horizontal support frame to guide rollers rotatably mounted on elongate members extending rearwardly from the ejector to guide movement of the ejector from the rear of the bowl to the mouth of the bowl when ejecting excavated ground material out of the mouth.

* * * * *